US009087484B2

(12) United States Patent
Shiroto et al.

(10) Patent No.: US 9,087,484 B2
(45) Date of Patent: Jul. 21, 2015

(54) CONTROL APPARATUS

(75) Inventors: Hironori Shiroto, Kobe (JP); Shogo Tanaka, Kobe (JP); Shinya Tanaka, Kobe (JP); Atsushi Hatagaki, Kobe (JP); Tomoyuki Nakamura, Kobe (JP)

(73) Assignee: FUJITSU TEN LIMITED, Kobe (JP)

( * ) Notice: Subject to any disclaimer, the term of this patent is extended or adjusted under 35 U.S.C. 154(b) by 911 days.

(21) Appl. No.: 13/302,569

(22) Filed: Nov. 22, 2011

(65) Prior Publication Data

US 2012/0139822 A1 Jun. 7, 2012

(30) Foreign Application Priority Data

Dec. 1, 2010 (JP) ..... 2010-268861

(51) Int. Cl.
*G09G 3/34* (2006.01)
*G09G 3/36* (2006.01)

(52) U.S. Cl.
CPC ..... *G09G 3/3406* (2013.01); *G09G 3/3611* (2013.01); *G09G 2310/0237* (2013.01); *G09G 2320/0633* (2013.01); *G09G 2360/16* (2013.01)

(58) Field of Classification Search
CPC ..... G09G 2310/0237; G09G 3/3406
USPC ..... 345/102
See application file for complete search history.

(56) References Cited

U.S. PATENT DOCUMENTS

2009/0066623 A1 * 3/2009 Ma et al. ..... 345/89

FOREIGN PATENT DOCUMENTS

| | | |
|---|---|---|
| JP | A-2003-149626 | 5/2003 |
| JP | A-2003-255914 | 9/2003 |
| JP | A-2004-62134 | 2/2004 |
| JP | A-2005-134724 | 5/2005 |
| JP | A-2008-83590 | 4/2008 |

* cited by examiner

*Primary Examiner* — Waseem Moorad
(74) *Attorney, Agent, or Firm* — Oliff PLC

(57) ABSTRACT

A control apparatus specifies a response time required for a pre-change transmittance specified by image data of an image to be displayed on the liquid crystal display panel to become a post-change transmittance specified by image data of a subsequent image, subsequent to the image, to be displayed on the liquid crystal display panel, for each pixel of the liquid crystal display panel, based on the pre-change transmittance and on the post-change transmittance; derives a representative response time defined as a response time of an image in a frame, based on the response time specified for each of the pixels; and sets an unlit time period of the backlight, between display of the image and the subsequent image, according to the representative response time.

15 Claims, 16 Drawing Sheets

104

| | | POST-CHANGE | | | |
|---|---|---|---|---|---|
| | | 0% | 30% | 70% | 100% |
| PRE-CHANGE | 0% | | 100ms 「+」 | 40ms 「+」 | 20ms 「+」 |
| | 30% | 30ms 「−」 | | 160ms 「+」 | 80ms 「+」 |
| | 70% | 20ms 「−」 | 40ms 「−」 | | 120ms 「+」 |
| | 100% | 10ms 「−」 | 20ms 「−」 | 30ms 「−」 | |

104

| | | POST-CHANGE | | | |
|---|---|---|---|---|---|
| | | 0% | 30% | 70% | 100% |
| PRE-CHANGE | 0% | | 100ms 「+」 | 40ms 「+」 | 20ms 「+」 |
| | 30% | 30ms 「−」 | | 160ms 「+」 | 80ms 「+」 |
| | 70% | 20ms 「−」 | 40ms 「−」 | | 120ms 「+」 |
| | 100% | 10ms 「−」 | 20ms 「−」 | 30ms 「−」 | |

Fig.3B db1

| SPECIFIC PATTERN | NUMBER OF PIXELS |
|---|---|
| 10ms「−」 | 990 |
| 20ms「−」 | 10000 |
| 30ms「−」 | 50000 |
| 40ms「−」 | 10000 |
| 20ms「+」 | 8000 |
| 30ms「+」 | 20000 |
| 40ms「+」 | 1000 |
| 50ms「+」 | 10 |

Fig.4A db2

| SPECIFIC PATTERN | NUMBER OF PIXELS |
|---|---|
| 10ms「−」 | 990 |
| 20ms「−」 | 10000 |
| 30ms「−」 | 50000 |
| 40ms「−」 | 10000 |
| 20ms「+」 | 8000 |
| 30ms「+」 | 20000 |
| 40ms「+」 | 1000 |
| 50ms「+」 | 10 |

Fig.4B $|\alpha 1| > |\beta 1| = H1 < H2$ $|\alpha 2|<|\beta 2|=H1>H2$

114c

| FIRST REPRESENTATIVE PATTERN | SECOND REPRESENTATIVE PATTERN | H11 |
|---|---|---|
| 50ms 「+」 | 50ms 「+」 | 10ms |
| | ... | ... |
| | 10ms 「−」 | 20ms |
| 50ms 「−」 | 50ms 「+」 | ... |
| | ... | ... |
| ... | ... | ... |

Fig.9B

CONTROL APPARATUS

BACKGROUND OF THE INVENTION

1. Field of the Invention

The invention relates to backlight control of a liquid crystal display panel.

2. Description of the Background Art

Conventionally, an image is displayed on a liquid crystal display (LCD) panel by turning on a backlight of a liquid crystal display and by appropriately changing a transmittance of light passing through the LCD panel.

When the transmittance of light passing through the LCD panel is changed, a response time of, for example, some milliseconds or some hundred milliseconds is required for a pre-change transmittance to reach a post-change transmittance (target transmittance). Therefore, a backlight is turned on in the middle of the change of the transmittance, an image is displayed for a user before the transmittance reaches the target transmittance. As a result, there was a case where an unclear image, mainly an unclear moving image, was displayed for the user.

Thus, a technology that sets the response time as a predetermined time period, and that turns of the backlight and keeps the backlight off until the predetermined time period passes and turns on the backlight after the predetermined time period passes, has been conventionally known.

However, in a case where a transmittance is changed, when at least one of a pre-change transmittance and a post-change transmittance is different from a subsequent pre-change transmittance and a subsequent post-change transmittance, a response time also changes. Therefore, in the case where a backlight of a LCD panel was turned off until the certain time period set as the response time passed and where the backlight was turned on after the certain time period passed, an image was displayed for the user before the transmittance reached the target transmittance. As a result, there was a case where an unclear and blurred image was displayed for the user.

The following are examples of different response times in which the transmittance starts to change and reaches a target transmittance. For example, as compared to a case where a transmittance that is 100% before a change becomes 70% after the change (where a change of the transmittance is small), in a case where a transmittance that is 100% before a change becomes 0% after the change (where a change of the transmittance is great), the response time is longer.

Moreover, in a case where voltage applied to liquid crystal molecules changes from zero to a value other than zero, the response time is longer than a case where voltage applied to the liquid crystal molecules changes from a value other than zero to zero. In other words, even when change rates at which transmittances change to target transmittances are the same, response times required for the transmittances to change are different.

SUMMARY OF THE INVENTION

According to one aspect of the invention, a control apparatus that controls a backlight providing light to a liquid crystal display panel includes a controller configured to: (i) specify a response time required for a pre-change transmittance specified by image data of an image to be displayed on the liquid crystal display panel to become a post-change transmittance specified by image data of a subsequent image, subsequent to the image, to be displayed on the liquid crystal display panel, for each pixel of the liquid crystal display panel, based on the pre-change transmittance and on the post-change transmittance; (ii) derive a representative response time defined as a response time of an image in a frame, based on the response time specified for each of the pixels; and (iii) set an unlit time period of the backlight, between display of the image and the subsequent image, according to the representative response time.

Thus, a blur in an image can be controlled and a clear image can be provided to a user.

According to another aspect of the invention, the controller included in the control apparatus is configured to: as part of (i), specify a fluctuation tendency showing one of an increase and a decrease of the transmittance over time, for each of the pixels; as part of (ii), derive a representative fluctuation tendency defined as a fluctuation tendency of an image in a frame, based on the fluctuation tendency specified for each of the pixels; and as part of (iii), set an offset time in the unlit time period based on the representative response time and the representative fluctuation tendency.

Thus, necessary luminance in a lighting time period of the backlight can be secured.

According to one aspect of the invention, the controller included in the control apparatus is configured to: as part of (ii), derive the representative response time and the representative fluctuation tendency based on a distribution of pixels of the liquid crystal display panel with respect to the response time and the fluctuation tendency.

Thus, the unlit time period including the offset time appropriate to an image to be displayed on the liquid crystal display panel, can be set.

Therefore, an object of the invention is to provide a technology to control a backlight according to a response time of a transmittance change of a liquid crystal display panel.

These and other objects, features, aspects and advantages of the invention will become more apparent from the following detailed description of the invention when taken in conjunction with the accompanying drawings.

BRIEF DESCRIPTION OF THE DRAWINGS

FIG. 3B illustrates an example of a specific table;

FIG. 4A illustrates an example of a process of deriving a representative pattern;

FIG. 4B illustrates an example of a specific process;

FIG. 9B illustrates an example of a process in a case where a lighting time period of a backlight is fixed.

DESCRIPTION OF THE EMBODIMENTS

Hereinafter embodiments of the invention are described, with reference to the drawings. The embodiments described below are only examples and the technical scope of the invention is not limited to the embodiments.

<Technical Outline>

Figure 1A:
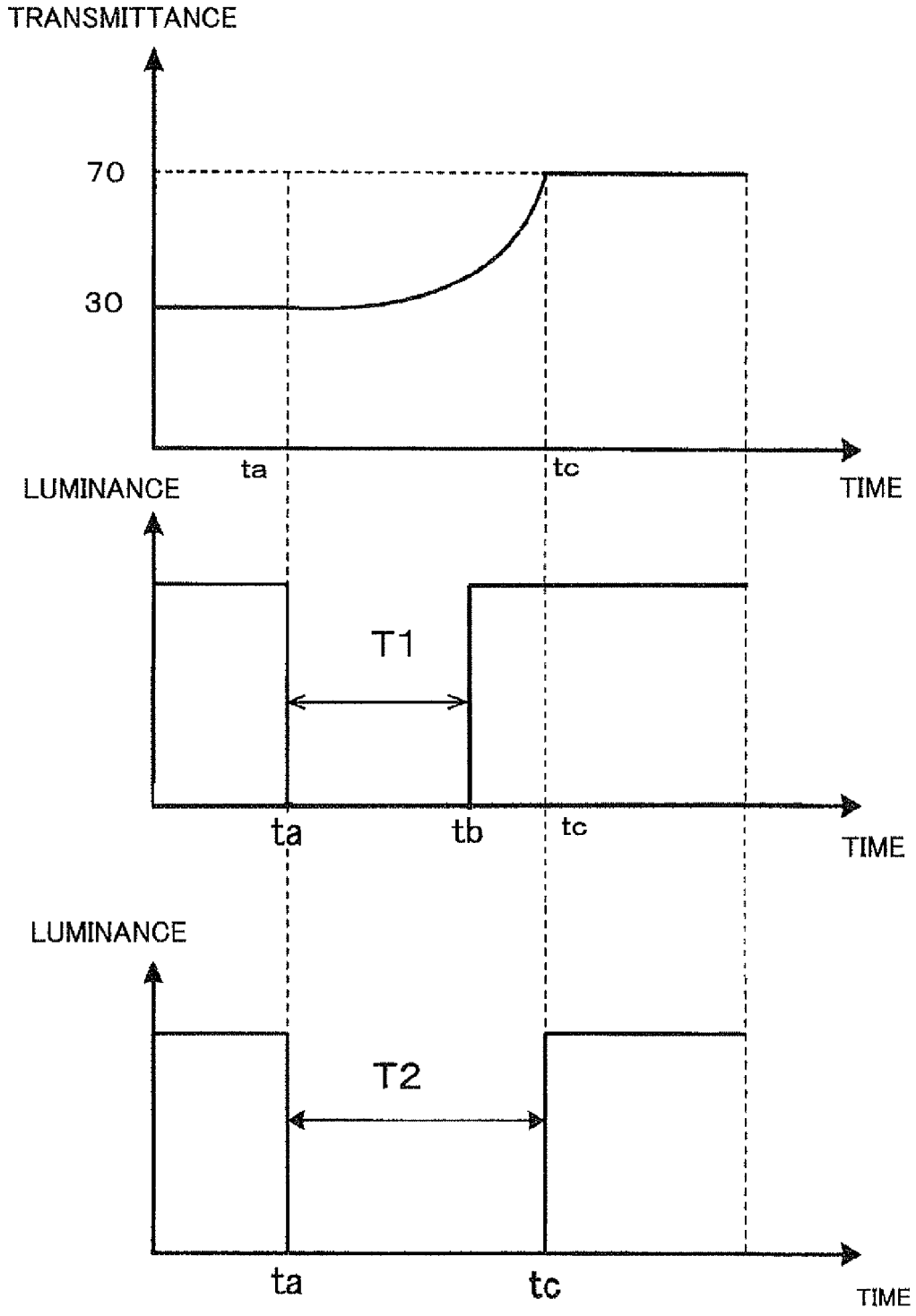
FIG. 1A illustrates an outline of backlight control.
Figure 1B:
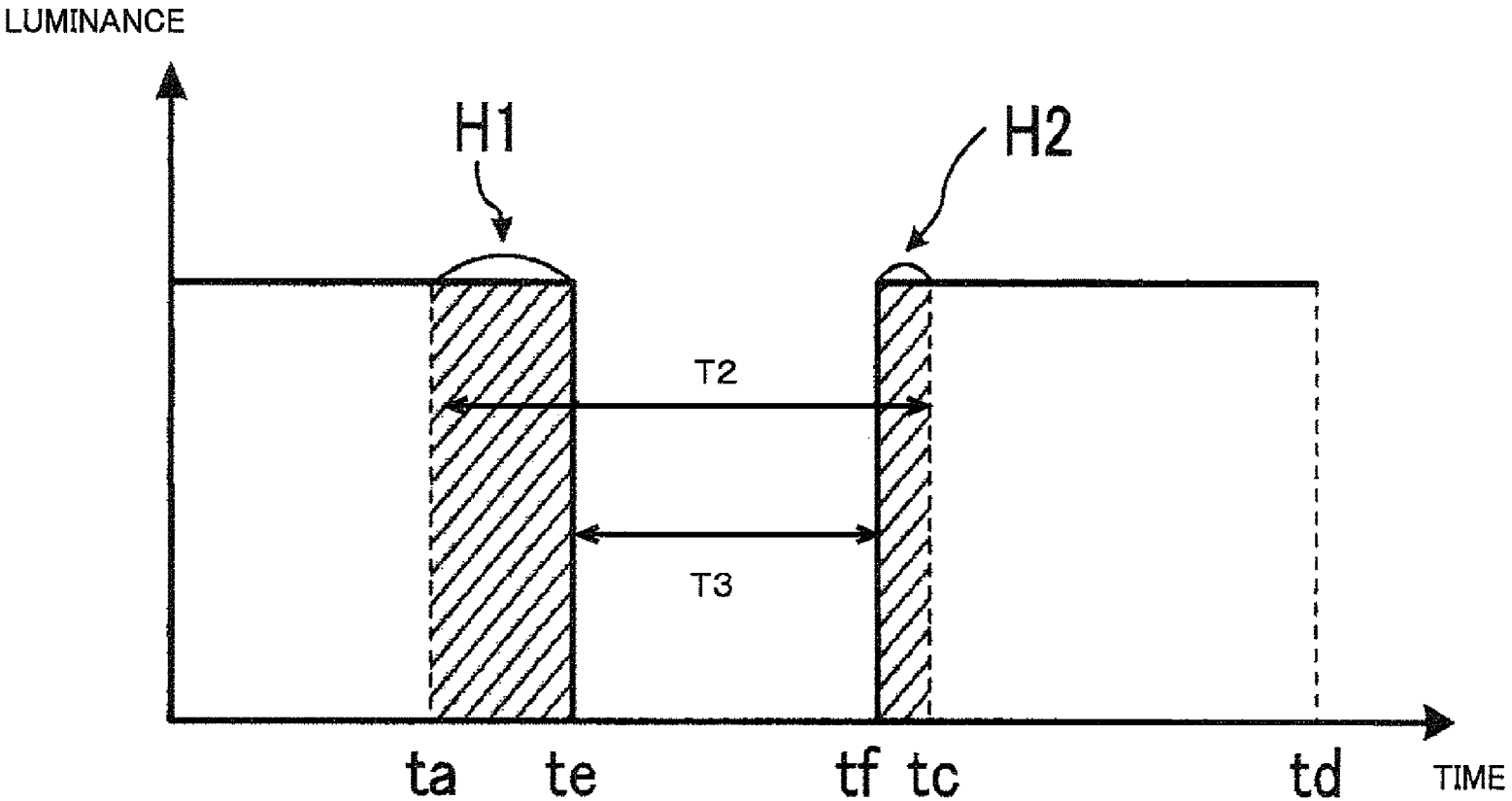
FIG. 1B illustrates an outline of backlight control.

Each of FIG. 1A and FIG. 1B illustrates an outline of backlight control.

A top drawing in FIG. 1A illustrates a time variation of a transmittance of light passing through a liquid crystal display (LCD) panel. A vertical axis of the drawing represents the transmittance of light passing through the LCD panel (e.g., a LCD panel 11 shown in FIG. 2) in percentage (%) and a horizontal axis of the drawing represents time in millisecond (ms). Concretely, the top drawing shows that a transmittance before a change (pre-change transmittance) is 30% and that a transmittance after the change (a post-change transmittance) is 70%. In other words, in a response time (from a time point ta to a time point tc), a process of changing the transmittance starts at the time point ta and ends at the time point tc when the transmittance reaches a target transmittance. The pre-change transmittance is specified based on image data of an image in a frame to be displayed on the LCD panel 11. The post-change transmittance is specified based on image data of an image in a subsequent frame, to be displayed on the LCD panel 11. As described above, the transmittance of light passing through the LCD panel 11 is changed every time when an image of a frame changes.

A middle drawing in FIG. 1A shows a conventional backlight control. A vertical axis of the drawing represents luminance of a backlight (e.g., a backlight 12*a* shown in FIG. 2) in cd/m$^2$ and a horizontal axis of the drawing represents time in millisecond (ms). The middle drawing shows an unlit time period T1 in which the backlight 12*a* is unlit from the time point ta to a time point tb. Concretely, a drive part (e.g., a drive part 12*b* shown in FIG. 2) turns off the backlight 12*a* that is on, at the time point ta based on a control signal transmitted from a drive controller 13*e*, described later, shown in FIG. 2. Moreover, the drive part 12*b* turns on the backlight 12*a* that is off, at the time point tb. As described above, conventionally, the drive controller 13*e* implemented timing control of turning on and turning off the backlight 12*a* based on the unlit time period T1 set as a predetermined time period, in other words, set as a predetermined time period having a uniform duration. Here, a term an unlit time period refers to a time period between display of the image and a subsequent image.

However, as shown in the top drawing in FIG. 1A, the transmittance becomes a target transmittance (70%) at the time point tc later than the time point tb. Therefore, when the backlight 12*a* is turned on at the time point tb where the unlit time period T1 starting at the time point ta ends, an unclear image may be displayed for a user because the image is displayed at a transmittance other than the target transmittance.

Therefore, as shown in a bottom drawing in FIG. 1A, an unlit time period T2 corresponding to a response time starting from the time point ta to the time point tc is set and the drive part 12*b* turns off at the time point ta and keeps the backlight 12*a* off until the time point tc. In other words, the drive part 12*b* turns off the backlight 12*a* based on the unlit time period T2, of the backlight 12*a*, matching time points when the transmittance starts to change and when the change of the transmittance ends. Thus, an image is displayed at the target transmittance and the clear image is displayed for the user.

The unlit time period T2, of the backlight 12*a*, matching the response time starting from the time point ta to the time point tc, is specified based on a value in a predetermined table. In other words, a specific table (e.g., a specific table 104 shown in FIG. 2 or in FIG. 4) indicating a relationship between the response time and a combination of the pre-change transmittance and the post-change transmittance is stored in a storage part (e.g., a storage part 14 shown in FIG. 2) beforehand. A specifying part 13*b*, later described, shown in FIG. 2 specifies the response time by using a value in the specific table 104.

The LCD panel 11 includes plural pixels, and the pre-change transmittance and the post-change transmittance vary among the pixels. The backlight 12*a* provides light uniformly to each of the plural pixels of the LCD panel 11. In other words, a response time is different for each of the plural pixels, but turn-on and turn-off control of the backlight 12*a* cannot be implemented for each of the plural pixels but implemented to all the plural pixels of the LCD panel 11 at once.

Therefore, the control of the backlight 12*a* is implemented as follows. A deriving part 13*c*, described later, shown in FIG. 2 derives a representative response time defined as a response time of an image in a frame based on the response time of each of the plural pixels of the LCD panel 11. Then a setting part 13*d*, described later, shown in FIG. 2 sets an unlit time period of the backlight 12*a*, according to the representative response time. Thus a clear image can be displayed for the user at the target transmission.

FIG. 1A, as described above, explains the outline of the process of controlling the backlight 12*a* such that the unlit time period of the backlight 12*a* matches the representative response time. If the backlight 12*a* is turned on and off intermittently, there is a case where user visibility to see the image is reduced due to insufficient luminance of the backlight. Therefore, as shown in FIG. 1B, an offset time is set to the unlit time period T2 corresponding to a time period from the time point ta when the transmittance starts to change to the time point tc when the change of the transmittance ends.

Concretely, the time point ta when the unlit time period starts is moved to a time point to (an offset time H1) to shorten the unlit time period. Moreover, the time point tc when the unlit time period ends is moved to a time point tf (an offset time H2) to also shorten the unlit time period. A vertical axis shown in FIG. 1B represents luminance of a backlight (e.g., the backlight 12*a* shown in FIG. 2) in cd/m$^2$ and a horizontal axis shown in FIG. 1B represents time in millisecond (ms).

As a result, a specific unlit time period (e.g., a specific unlit time period T3 shown in FIG. 1B) shorter than the unlit time period T2 is set as a new unlit time period. Thus, insufficient luminance of the backlight 12*a* can be supplemented and a clear image can be displayed for the user.

A deriving process of deriving an offset time is implemented as follows. The offset time is derived based on the representative response time defined as a response time for an image in a frame based on the response time of each of the plural pixels and a representative fluctuation tendency defined as a fluctuation tendency for an image in a frame based on the fluctuation tendency of each transmittance (hereinafter the representative response time and the representative fluctuation tendency are also collectively referred to as "representative pattern"). Here, the fluctuation tendency shows a tendency of an increase or a decrease of a transmittance over time, and each of the plural pixels has the fluctuation tendency.

Hereinafter embodiments of the invention are described in detail.

First Embodiment

Figure 2:
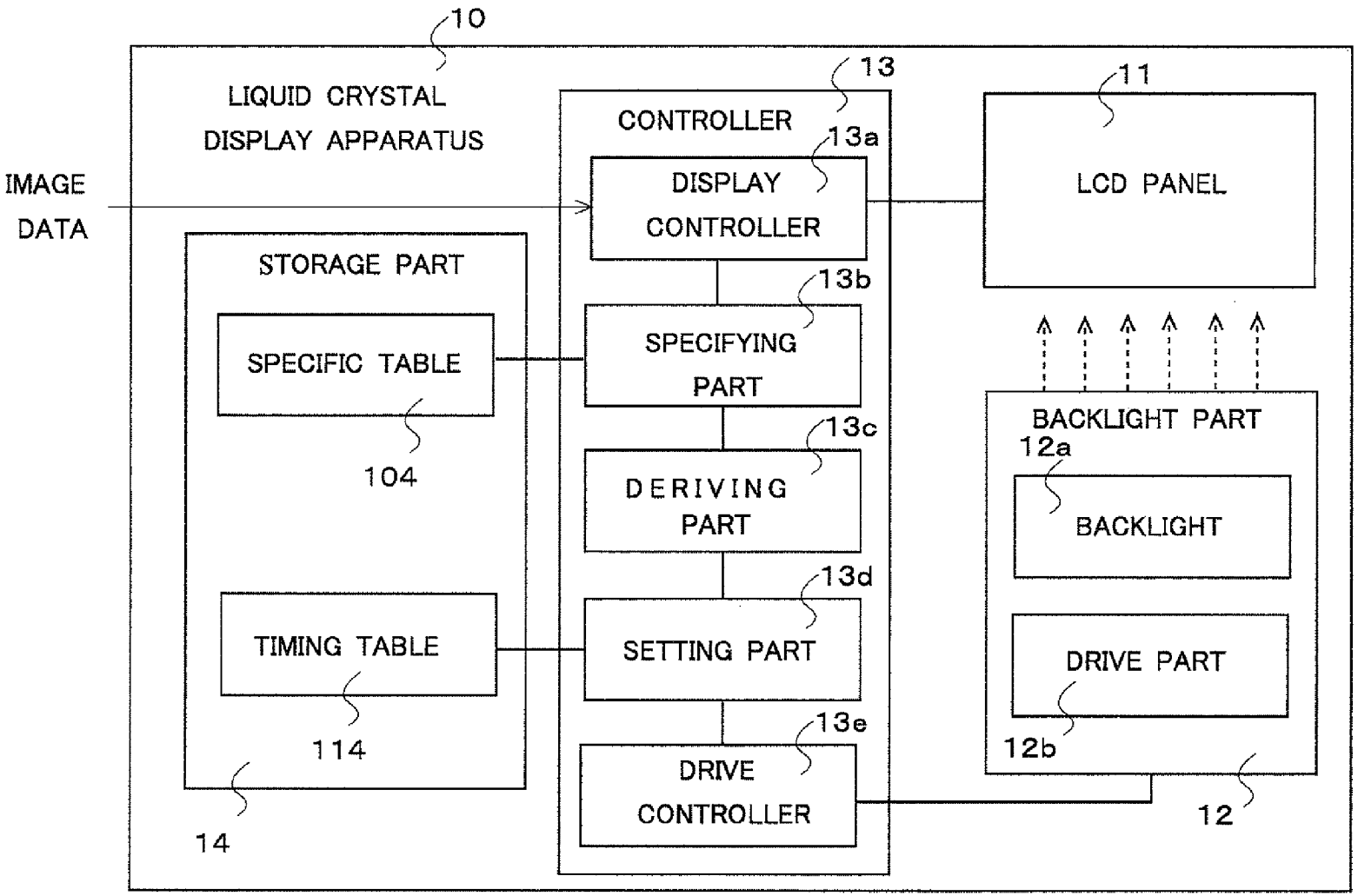
FIG. 2 is a block diagram of a liquid crystal display.

FIG. 2 is a block diagram illustrating a configuration of a liquid crystal display apparatus 10 in this embodiment. The liquid crystal display apparatus 10 includes a liquid crystal display (LCD) panel 11, a backlight part 12, a controller 13, and a storage part 14. Moreover, the controller 13 includes a display controller 13*a*, a specifying part 13*b*, a deriving part 13*c*, a setting part 13*d*, and a drive controller 13*e*. Furthermore, the backlight part 12 includes a backlight 12*a* and a drive part 12*b*. In addition, the storage part 14 stores a specific table 104 and a timing table 114.

The LCD panel 11 is an image display that displays an image by partially blocking or transmitting light provided from the backlight 12*a*, by using liquid crystal molecules. The LCD panel 11 performs a process of changing a pre-change transmittance of light at each of the plural pixels of the LCD panel 11 to a post-change transmittance (a target transmittance). More concretely, the pre-change transmittance is specified based on image data of an image in a frame to be displayed on the LCD panel 11. Moreover, the post-change transmittance is specified based on image data of an image in a subsequent frame, to be displayed on the LCD panel 11.

The backlight part 12 is a lighting apparatus that includes the backlight 12*a* providing light to a back side of the LCD panel 11, and the drive part 12*b* controlling turn-on or turn-off of the backlight 12*a* based on a control signal transmitted from the drive controller 13*e*. Moreover, the drive part 12*b* adjusts luminance of the backlight 12*a* based on a control signal transmitted from the drive controller 13*e*.

The controller 13 controls the whole liquid crystal display apparatus 10. When receiving image data of an image in a frame from a device outside of the liquid crystal display apparatus 10, the display controller 13*a* of the controller 13 sets a transmittance of each of the plural pixels of the LCD panel 11 according to the image data, and transmits information on the transmittance of each of the plural pixels to the LCD panel 11 and to the specifying part 13*b*.

The specifying part 13*b* specifies a response time and a fluctuation tendency of the transmittance based on the pre-change transmittance and the post-change transmittance. (Hereinafter the response time and the transmittances are also collectively referred to as "specific pattern.") Here, the response time is a time period required for the pre-change transmittance to become the post-change transmittance, for each of the plural pixels of the LCD panel 11. Moreover, the fluctuation tendency shows a tendency of an increase or a decrease in the transmittance over time, for each of the plural pixels.

Figure 3A:
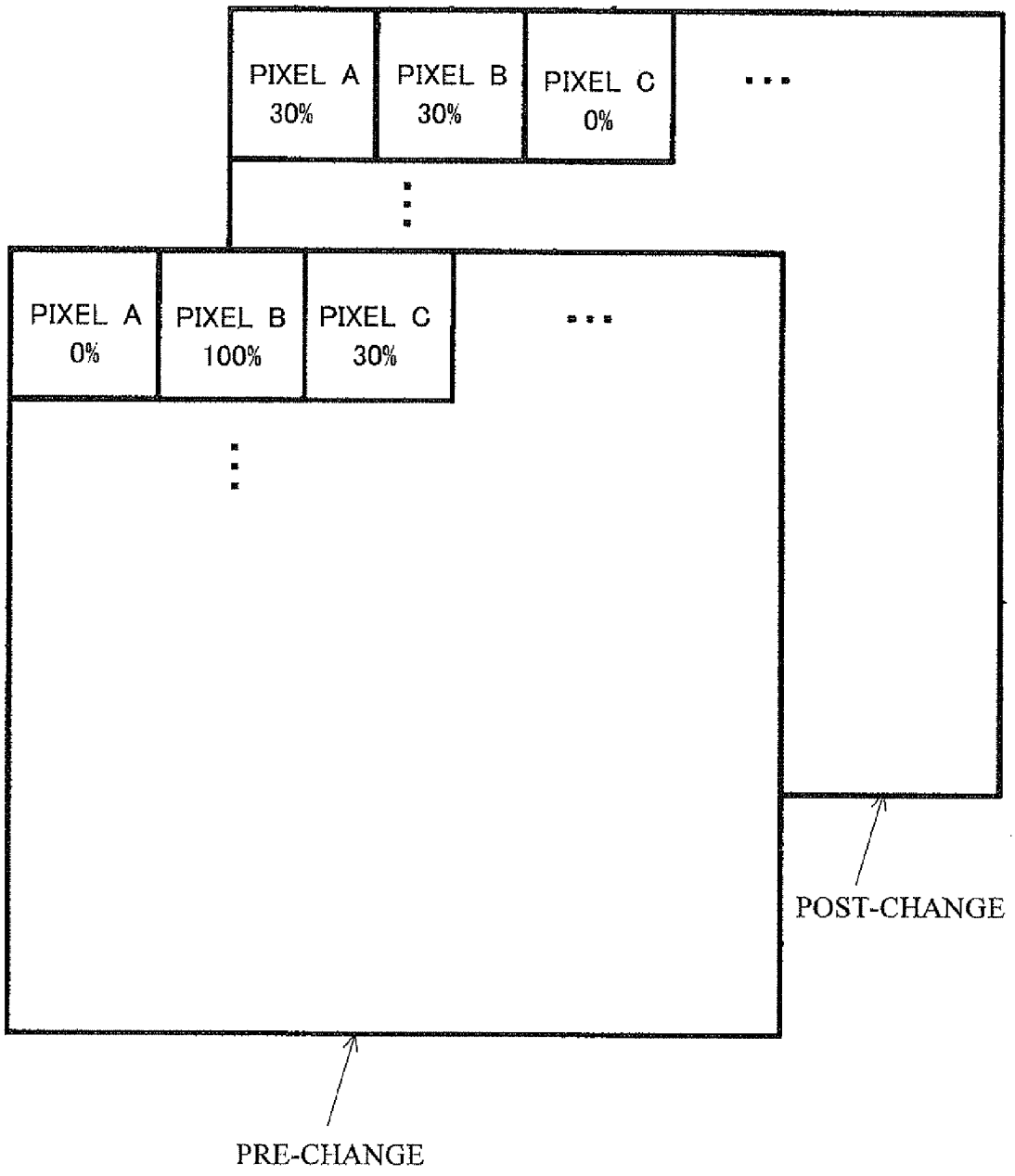
FIG. 3A illustrates examples of a pre-change transmittance and a post-change transmittance of each pixel.
Figure 3C:
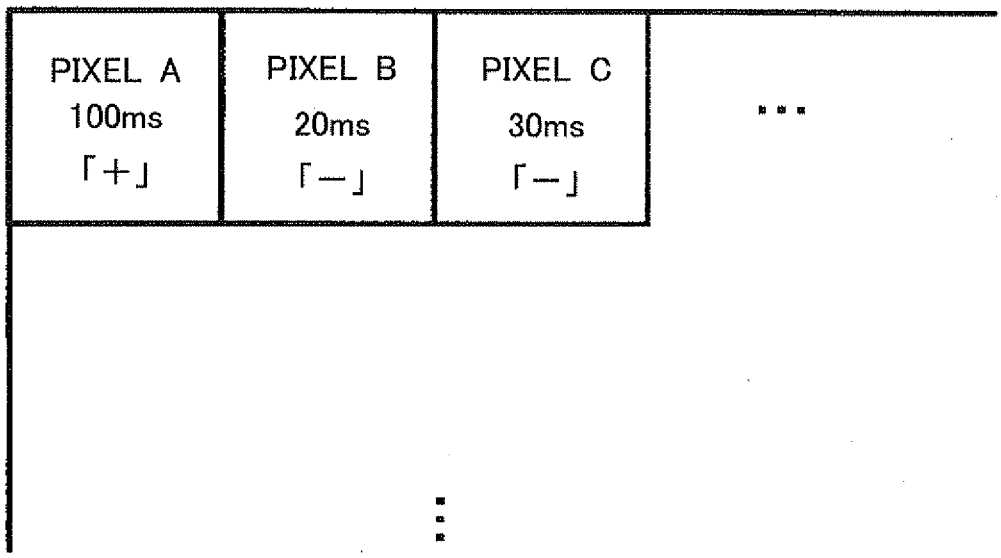
FIG. 3C illustrates examples of a specific pattern.

Next described is an example of a specific process of a specific pattern, performed by the specifying part 13*b*. FIG. 3A illustrates examples of the pre-change transmittance and the post-change transmittance of each of the plural pixels. Moreover, FIG. 3B illustrates an example of the specific table 104. Furthermore, FIG. 3C illustrates examples of the specific pattern to be specified by the specifying part 13*b*.

The specifying part 13*b* specifies the specific pattern for each of the plural pixels, referring to the specific table 104, by receiving information on the pre-change transmittance and the post-change transmittance of each of the plural pixels from the display controller 13*a*. Values shown in FIG. 3A are examples of the pre-change transmittances and the post-change transmittances that the specifying part 13*b* receives from the display controller 13*a*. For example, pre-change transmittances of a pixel A, a pixel B, and a pixel C are 0%, 100%, and 30% respectively. Moreover, post-change transmittances of the pixel A, the pixel B, and the pixel C are 30%, 30%, and 0% respectively.

The specific table 104 is a table, as shown in FIG. 3B, in which each of the specific patterns including the response time and the fluctuation tendency corresponds to a combination of the pre-change transmittance and the post-change transmittance. Hereinafter, a symbol "−" (minus) represents a decrease tendency of the fluctuation tendency of the transmittance, and a symbol "+" (plus) represents an increase tendency of the fluctuation tendency of the transmittance.

Concretely, a combination of the pre-change transmittance of 100% and the post-change transmittance of 70% corresponds to the response time of 30 ms and the fluctuation tendency of "−". Moreover, a combination of the pre-change transmittance of 0% and the post-change transmittance corresponds of 70% corresponds to the response time of 40 ms and the fluctuation tendency of "+". In comparison between two response times in which change rates of the transmittances are different, like the examples described above, the response time in which a change rate of the transmittance is smaller (from 100% to 70%) is longer than the response time in which a change rate of the transmittance is greater (from 0% to 70%).

Moreover, a combination of the pre-change transmittance of 0% and the post-change transmittance of 100% corresponds to the response time of 20 ms and the fluctuation tendency of "+". Furthermore, a combination of the pre-change transmittance of 100% and the post-change transmittance of 0% corresponds to the response time of 10 ms and the fluctuation tendency of "−". Even when the transmittances are changed at the same rate, the response time required to increase the transmittance (from 0% to 100%) is longer than the response time required to decrease the transmittance (from 100% to 0%), for example, in a case of normally white TN liquid crystal display panel.

The specifying part 13*b* specifies, based on the specific table 104, a specific pattern corresponding to the pixel A of which the pre-change transmittance is 0% and the post-change transmittance is 30%. As a result, as shown in FIG. 3C, a combination of the response time of 100 ms and the fluctuation tendency of "+" is specified as the corresponding specific pattern for the pixel A. Similarly, the specifying part 13*b* specifies a combination of the response time of 20 ms and the fluctuation tendency of "−", and a combination of the response time of 30 ms and the fluctuation tendency of "−" respectively as the specific patterns of the pixel B and the pixel C.

After specifying the specific patterns of all the plural pixels of the LCD panel 11, the specifying part 13*b* transmits information on the specific patterns specified, to the deriving part 13*c*.

Referring back to FIG. 2, the deriving part 13*c* derives a representative pattern based on the specific pattern received from the specifying part 13*b*. The representative pattern includes the representative response time and the representative fluctuation tendency. Here, as described above, the representative response time is defined as a response time for an image in a frame based on the response time of each of the plural pixels of the LCD panel 11. Moreover, the representative fluctuation tendency is defined as a fluctuation tendency for an image in a frame based on the fluctuation tendency of each of the plural pixels of the LCD panel 11.

The deriving part 13*c* derives the representative pattern based on a distribution of the plural pixels each of which has a specific pattern out of plural specific patterns. In other words, the deriving part 13*c* derives the representative response time and the representative fluctuation tendency based on the distribution of the plural pixels of the LCD panel for each of combinations of the response time and the fluctuation tendency. Thus, an unlit time period, of the backlight 12*a*, including an offset time appropriate to an image to be displayed on the LCD panel 11, is set.

FIG. 4A illustrates an example of a process of deriving the representative pattern. As shown in FIG. 4A, the deriving part 13*c* derives the representative pattern based on a distribution table db1 indicating the distribution of the plural pixels for each of the specific patterns. Concretely, the deriving part 13*c* excludes a specific pattern, out of the specific patterns, that accounts for less than a predetermined percentage (e.g., less than 5% equivalent to 5,000 pcs.) of a total number of the plural pixels (e.g., 100,000 pcs.) of the LCD panel 11. In other words, in FIG. 4A, the deriving part 13*c* excludes specific patterns having 10 ms and "–", 40 ms and "+", and 50 ms and "+" shown in the distribution table db1.

Then the deriving part 13*c* derives a specific pattern having a longest response time, out of the remaining specific patterns, as the representative pattern. In other words, the deriving part 13*c* derives a specific pattern having 40 ms and "–" shown in the distribution table db1, as the representative pattern.

In such a manner, the deriving part 13*c* excludes the specific pattern of pixels accounting for less than the predetermined percentage, from a representative pattern choice, and derives a specific pattern having the longest response time, out of the remaining specific patterns, as the representative pattern. Thus, after the transmittance of the whole LCD panel 11 becomes the target transmittance, an image can be displayed. As a result, a clear image can be displayed for the user.

Moreover, without excluding the specific pattern of pixels accounting for less than the predetermined percentage, the deriving part 13*c* may derive, as the representative pattern, a specific pattern (30 ms and "–") of pixels accounting for the largest percentage (e.g., 50,000 pcs.), out of all the specific patterns, as shown in a distribution table db2 in FIG. 4B indicating the number of pixels for each of the specific patterns. In such a manner, the deriving part 13*c* derives the specific pattern of the pixels accounting for the largest percentage to whole the plural pixels of the LCD panel 11. As a result, a clear image can be displayed for the user.

Furthermore, the deriving part 13*c* may derive a specific pattern having a longest response time, out of all the patterns, as the representative pattern. In addition, the deriving part 13*c* may derive the representative pattern based on a predetermined formula using the pre-change transmittance and the post-change transmittance of each of the plural pixels.

Referring back to FIG. 2, the setting part 13*d* receives information on the representative pattern from the deriving part 13*c*. Then the setting part 13*d* sets an unlit time period of the backlight 12*a* according to the representative pattern. For example, in a case of the representative pattern having 40 ms and "–", the setting part 13*d* sets the unlit time period of the backlight 12*a* at 40 ms, according to the representative response time included in the representative pattern.

The setting part 13*d* sets the offset time according to the representative fluctuation tendency included in the representative pattern. The offset time is set based on, for example, a timing table (e.g., the timing table 114 shown in FIG. 5A). The unlit time period of the backlight 12*a* is changed according to the offset time, and then the specific offset time is set. Thus, necessary luminance is secured while the backlight 12*a* is on.

Here, the offset time refers to a time period by which a time point when the backlight 12*a* is turned off is moved to a later time point to shorten the unlit time period, and to a time period by which a time point when the backlight 12*a* is turned on is moved to an earlier time point to shorten the unlit time period. The offset time is changed when an image in a frame is changed to an image in a subsequent frame.

The timing table 114 shown in FIG. 2 includes a decrease table (e.g., a decrease table 114*a* shown in FIG. 5A) used when the representative fluctuation tendency shows a decrease, and an increase table (e.g., an increase table 114*b* shown in FIG. 5B) used when the representative fluctuation tendency shows an increase.

The setting part 13*d* selects one of the decrease table 114*a* and the increase table 114*b*, according to the representative fluctuation tendency. Then, the setting part 13*d* sets a first offset time H1 (hereinafter also referred to as "time H1") and a second offset time H2 (hereinafter also referred to as "time H2"), both corresponding to the representative response time included in the representative pattern, by using the table selected.

Figure 5A:
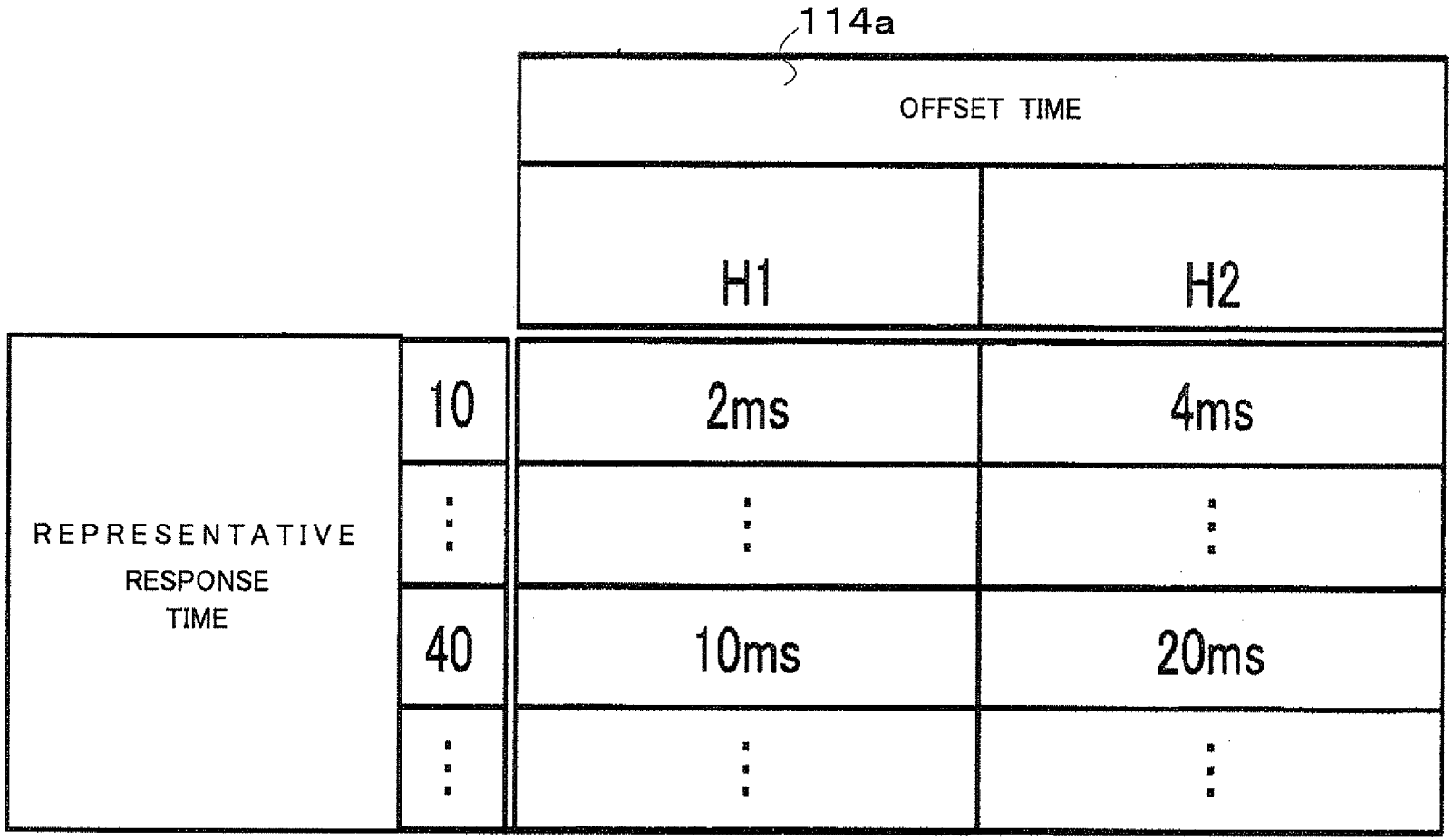
FIG. 5A illustrates an example of a timing table.
Figure 5B:
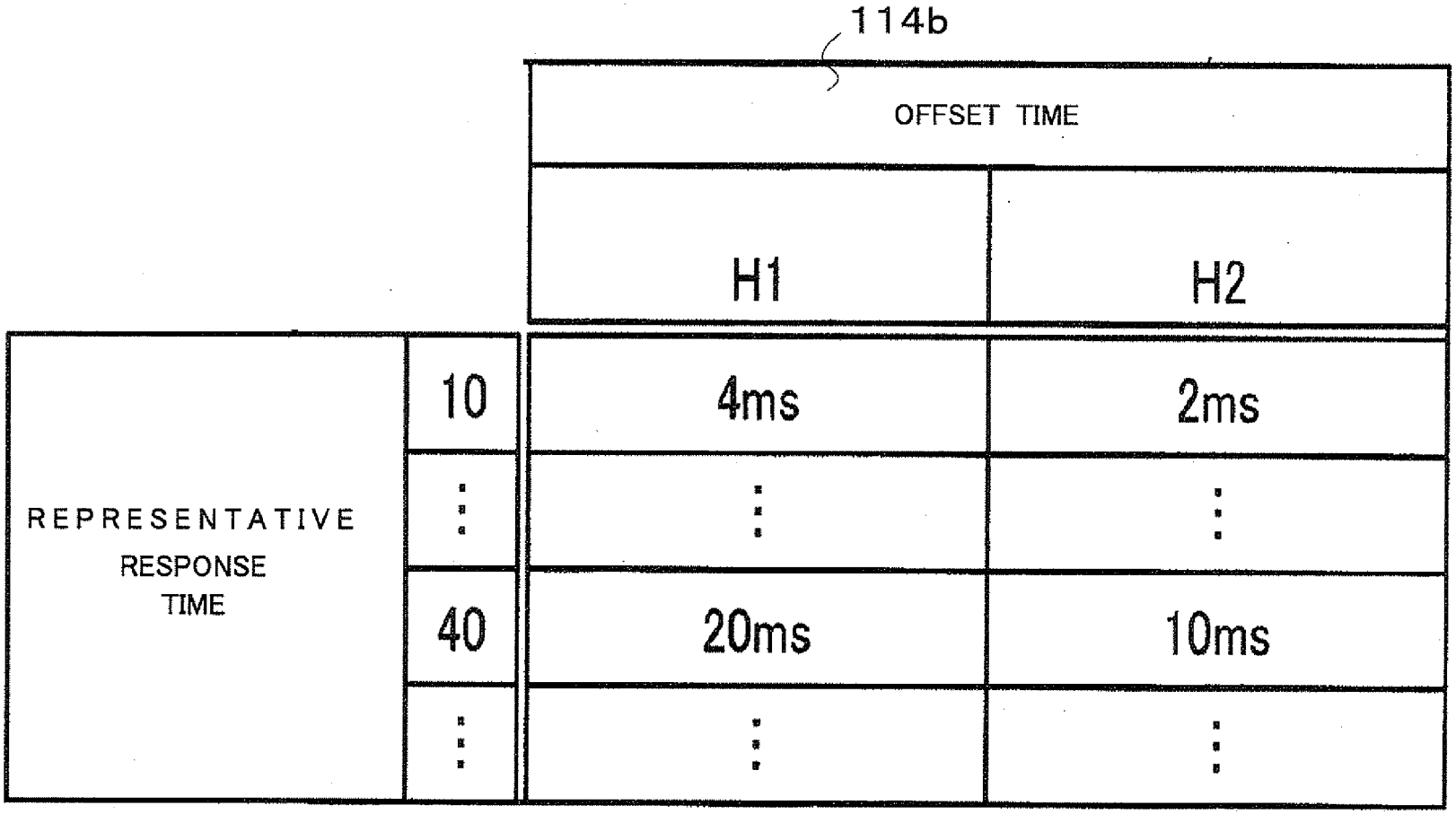
FIG. 5B illustrates an example of a timing table.

The decrease table 114*a* shown in FIG. 5A and the increase table 114*b* shown in FIG. 5B indicate the time H1 and the time H2 for each of the representative response times. The decrease table 114*a* and the increase table 114*b* share a characteristic in common that the time H1 and the time H2 become longer as the representative response time becomes longer.

On the other hand, the decrease table 114*a* has a different characteristic from the increase table 114*b* in terms of a relationship between a duration of time H1 and a duration of time H2. In other words, the time H1 is shorter than the time H2 in the decrease table 114*a*, and the time H1 is longer than the time H2 in the increase table 114*b*.

Figure 6A:
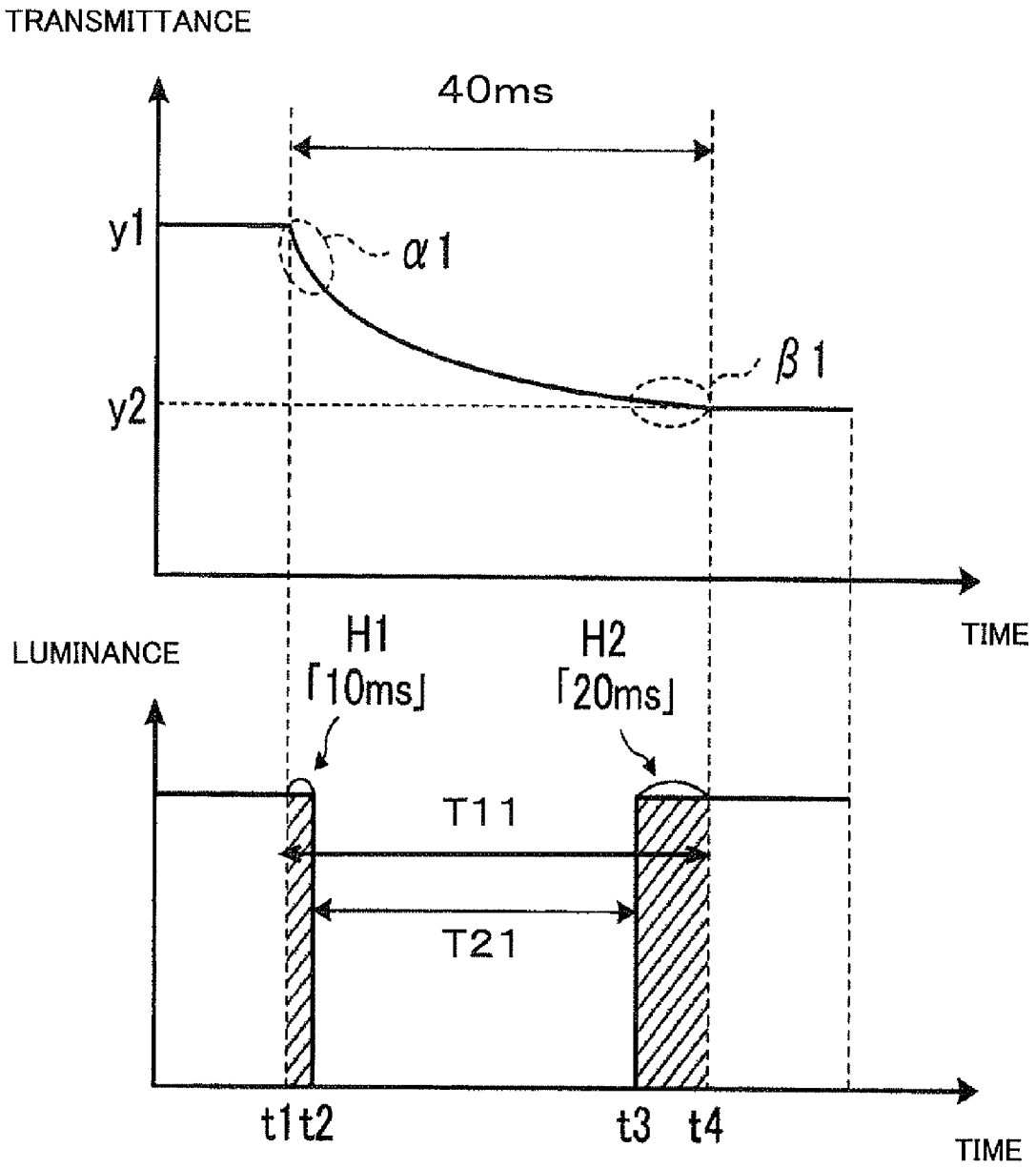
FIG. 6A illustrates an example of a time-point-setting process.
Figure 6B:
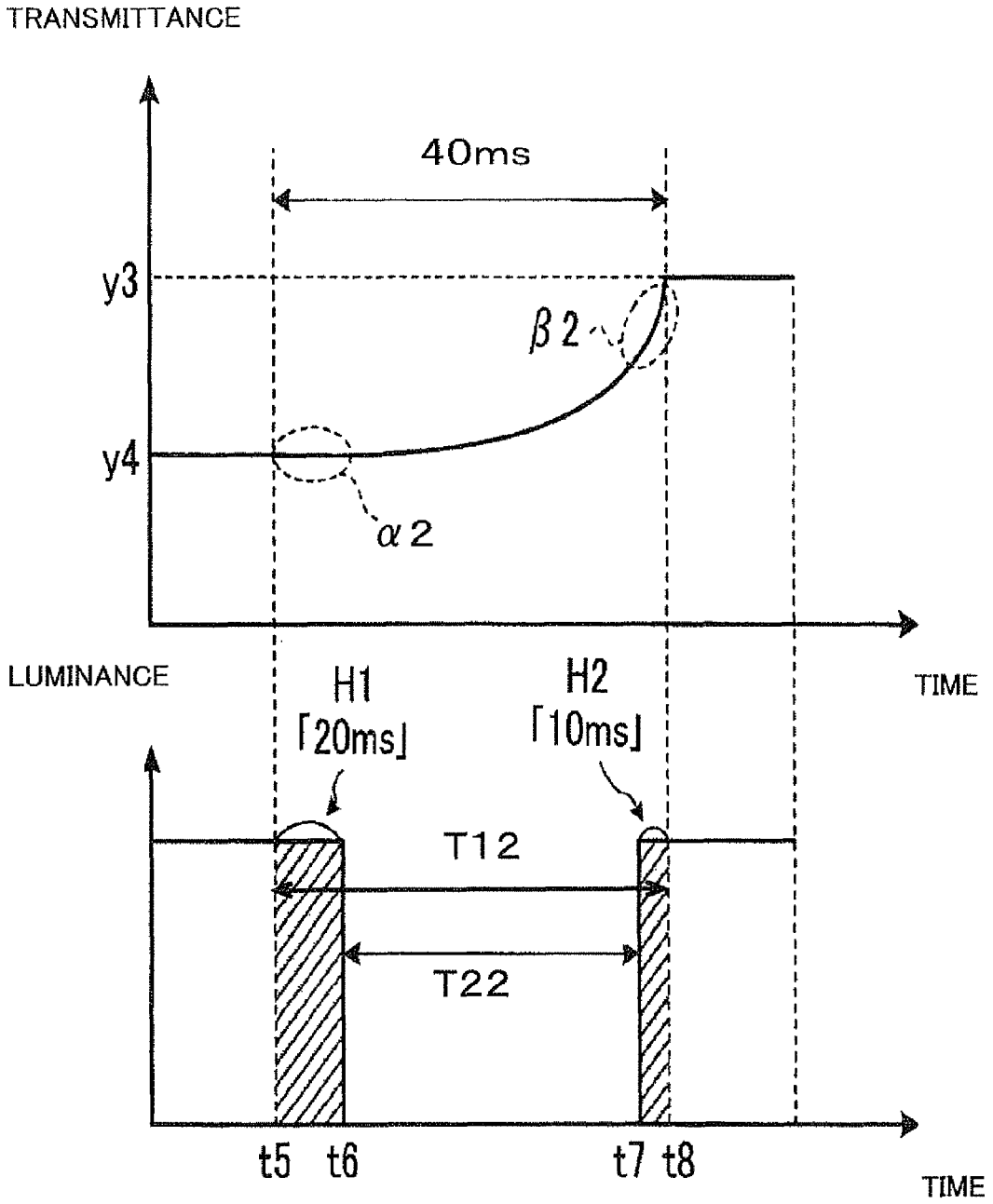
FIG. 6B illustrates an example of a time-point-setting process.

Next, an example of a process in which the setting part 13*d* sets the offset time is described, with reference to FIG. 6A and FIG. 6B. FIG. 6A illustrates an example of setting the offset time of a representative pattern having the response time of 40 ms and the fluctuation tendency of "–". In other words, FIG. 6A illustrates the setting of the offset time when the representative fluctuation tendency shows a decrease. On the other hand, FIG. 6B illustrates an example of setting the offset time of a representative pattern having the response time and of 40 ms and the fluctuation tendency of "+". In other words, FIG. 6B illustrates the setting of the offset time when the representative fluctuation tendency shows an increase.

When the response time and the fluctuation tendency of the representative pattern are 40 ms and "–", respectively, as shown in FIG. 6A, the setting part 13*d* sets the offset time H1 of 10 ms and the offset time H2 of 20 ms corresponding to the representative response time of 40 ms, to the unlit time period, based on the decrease table 114*a*.

Then, as shown in FIG. 6A, the drive part 12*b* turns off the backlight 12*a*, according to the control signal transmitted from the drive controller 13*e*, at a time point (a time point t2) when the time H1 (10 ms) passes from a time point (a time point t1) when the pre-change transmittance (a transmittance y1) starts to change. Moreover, the drive part 12*b* turns on the backlight 12*a* at a time point (a time point t3) the time H2 (20 ms) earlier than a time point (a time point t4) when the representative response time of 40 ms passes from the time point (the time point t1) when the pre-change transmittance starts to change.

As shown in FIG. 6A, when the representative fluctuation tendency shows a decrease, the time H1 is set to be shorter than the time H2 because, in a case of an unlit time period T11 (from the time point t1 to the time point t4), a change rate al of the transmittance in a proximity of the time point t1 when the transmittance starts to change is greater than a change rate β1 of the transmittance in a proximity of the time point t4 when the change of the transmittance ends. Therefore, the offset time is set to the unlit time period T11 to shorten the unlit time period. However, if each of offset times having a same duration is set to each of the proximity of the time point t4 and to the proximity of the time point t1, there is a possibility that an unclear image is displayed for the user because the change rate of the transmittance in the proximity of the time point t1 is greater than the change rate of the transmittance in the proximity of the time point t4.

Therefore, the setting part 13*d* sets a shorter offset time in a time period in which a change rate of the transmittance is greater, and sets a longer offset time in a time period in which a change rate of the transmittance is smaller. In other words, the setting part 13*d* sets the time H1 to be shorter than the time H2 (the first offset time of 10 ms and the second offset time of 20 ms). As a result, a specific unlit time period T21 shorter than the unlit time period T11 is set as a new unlit time period. Thus, luminance of the backlight 12*a* can be kept constant according to a change rate of the transmittance even when the luminance possibly becomes insufficient. Therefore, a clear image can be displayed for the user.

On the other hand, when the representative fluctuation tendency shows an increase, the relationship between the duration of the time H1 and the duration of the time H2 is reversed. In other words, in a case of the representative pattern having 40 ms and "+", the setting part 13*d* sets the time H1 of 20 ms and the time H2 of 10 ms corresponding to the representative response time of 40 ms, based on the increase table 114*b*. In other words, when the representative fluctuation tendency shows an increase, the time H1 is set to be longer than the time H2 to an unlit time period T12.

As shown in FIG. 6B, the drive part 12*b* turns off the backlight 12*a* at a time point (a time point t6) when the first offset time H1 (20 ms) passes from a time point when the pre-change transmittance (a transmittance y3) starts to change. Moreover, the drive part 12*b* turns on the backlight 12*a* at a time point (a time point t7) the time H2 (10 ms) earlier than a time point (a time point t8) when the representative response time of 40 ms passes from a time point (a time point t5) when the pre-change transmittance starts to change.

As shown in FIG. 6B, in a case of the unlit time period T12 (from the time point t5 to the time point t8), a change rate $\alpha 2$ of the transmittance in a proximity of the time point t5 when the transmittance starts to change is smaller than a change rate $\beta 2$ of the transmittance in a proximity of the time point t8 when the change of the transmittance ends. Therefore, the offset time is set to the unlit time period T21 to shorten the unlit time period. Concretely, the setting part 13*d* sets the time H1 to be longer than the time H2 (the first offset time of 20 ms and the second offset time of 10 ms).

As a result, a specific unlit time period T22 shorter than the unlit time period T12 is set as a new unlit time period. Thus, luminance of the backlight 12*a* can be kept constant according to a change rate of the transmittance even when the luminance possibly becomes insufficient. Therefore, a clear image can be displayed for the user.

A reason for setting the offset time is as follows. When the backlight 12*a* is unlit for a long time period, there is a case where the luminance of the backlight 12*a* is not sufficient enough to display an image on the LCD panel 11. Therefore, a duration of the unlit time period of the backlight 12*a* is adjusted, by keeping the backlight 12*a* unlit during a change of the transmittance and by setting the offset time in the unlit time period. Thus the luminance of the backlight is secured and a clear image can be provided to the user.

With reference back to FIG. 2, the drive controller 13*e* transmits a turn-on or turn-off control signal to the drive part 12*b* at the time point when the backlight 12*a* is turned on or is turned off. When receiving the control signal, the drive part 12*b* controls the turn-on or turn-off of the backlight 12*a*.

Figure 7:
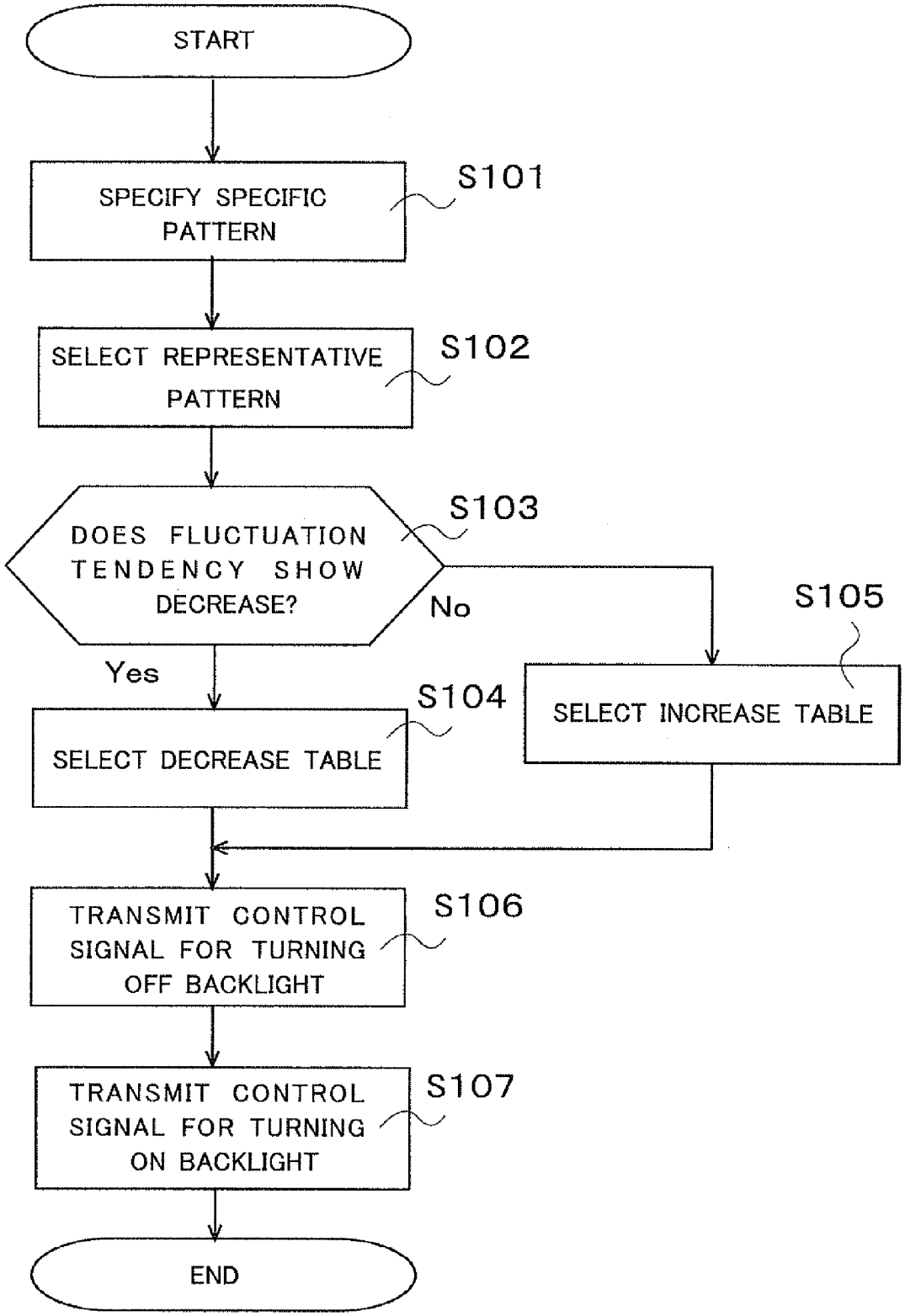
FIG. 7 is a flowchart illustrating a procedure for backlight control.

Next described is a procedure for backlight control performed by the liquid crystal display apparatus 10, with reference to FIG. 7. FIG. 7 is a flowchart illustrating the procedure for the backlight control.

As shown in FIG. 7, the specifying part 13*b* of the controller 13 specifies the specific pattern based on the pre-change transmittance and the post-change transmittance (a step S101), and then the deriving part 13*c* derives the representative pattern based on the distribution of the multiple pixels of the specific patterns (a step S102).

Next, the setting part 13*d* determines whether or not the representative fluctuation tendency shows a decrease (a step S103). When the representative fluctuation tendency shows a decrease (Yes in the step S103), the setting part 13*d* selects the decrease table 114*a* and sets the time H1 and the time H2 corresponding to the representative response time to the unlit time period (a step S104).

On the other hand, when the representative fluctuation tendency shows an increase (No in the step S103), the setting part 13*d* selects the increase table 114*b* and sets the time H1 and the time H2 corresponding to the representative response time to the unlit time period (a step S105).

The drive controller 13*e* transmits to the drive part 12*b* the control signal for turning off the backlight 12*a* at the time point (the time point t2) when the time H1 passes from a time point (the time point t1 in FIG. 6A) when the transmittance starts to change (a step S106). Moreover, the drive controller 13*e* transmits to the drive part 12*b* the control signal for turning on the backlight 12*a* at a time point (the time point t3) the offset time H2 earlier than the time point (the time point t4) when the change of the transmittance ends (a step S107).

In the aforementioned embodiment, the setting part 13*d* sets the unlit time period of the backlight 12*a*, corresponding to the representative response time included in the representative pattern, and selects the offset time according to the representative fluctuation tendency included in the representative pattern. Then, the specific unlit time period is shortened by setting the offset time in the unlit time period. On the other hand, the unlit time period may be set according to the representative response time, instead of setting the offset time in the unlit time period by the setting part 13*d*. Thus, a clear image can be provided to the user.

Second Embodiment

The following is a difference between a second embodiment and the first embodiment. In the first embodiment, the duration of the unlit time period of the backlight 12*a* is changed every time when an image in a frame displayed on the LCD panel 11 is changed. However, when the duration of the unlit time period is changed for each image in a frame, the duration of the lighting time period of the backlight 12*a* is also changed for each image in a frame. As a result, a sum value of the luminance of the backlight 12*a* in one lighting time period is changed for each image in a frame. Thus there is a case where user visibility to see the image is reduced. Therefore, in the second embodiment, the sum value of the luminance (sum luminance value) of a backlight 12*a* in one lighting time period is not changed for each image in a frame but is kept constant. The configuration and the process in the second embodiment is substantially the same as the configuration and the process in the first embodiment, except the constant luminance in one lighting time period. Therefore, a description of a same portion in the configuration and in the process is omitted.

A drive controller 13*e* transmits to a drive part 12*b* a control signal for changing a luminance value of the backlight 12*a* such that the sum luminance value is kept constant for each lighting time period in which the backlight 12*a* is on.

Figure 8:
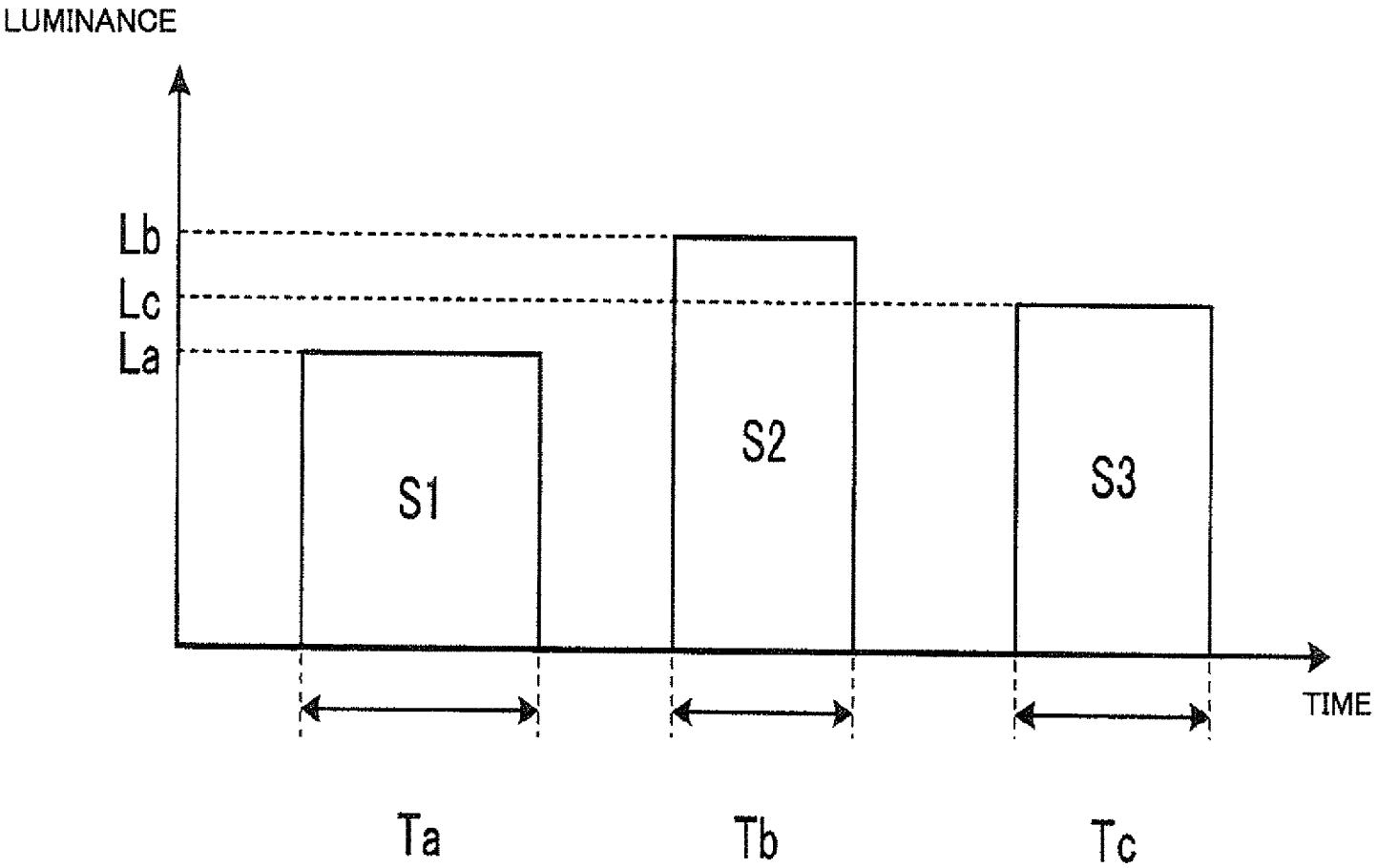
FIG. 8 illustrates an adjustment of backlight luminance.

FIG. 8 illustrates a change of the luminance value of the backlight 12*a*. FIG. 8 shows lighting time periods Ta, Tb, and Tc each of which has a different duration. Each of the lighting time periods Ta, Tb, and Tc shows the lighting time period of the backlight 12*a*. An unlit time period is provided between the lighting time periods Ta and Tb, and between the lighting time periods Tb and Tc. In other words, the backlight 12*a* is turned on intermittently.

Here, the lighting time period Ta is the longest, the lighting time period Tc is the second longest and then lighting time period Tb is the third longest. The drive controller 13*e* transmits to the drive part 12*b* a control signal for setting the backlight 12*a*, in the lighting time period Tb shortest among the three lighting time periods, at a luminance value (luminance Lb) higher than luminance values in the two other time periods, to make the sum luminance value in each of the lighting time periods to be the same as the sum luminance values in the other lighting time periods.

The drive controller 13*e* transmits to the drive part 12*b* a control signal for setting the backlight 12*a*, in the lighting time period Ta longest among the three lighting time periods, at a luminance value (luminance La) lower than luminance values in the two other time periods. Moreover, the drive controller 13*e* transmits to the drive part 12*b* a control signal for setting the backlight 12*a*, in the lighting time period Tc second longest among the three lighting time periods, at a luminance value (luminance Lc) between the luminance values in the two other time periods. The total luminance values is stored beforehand in a storage part 14, and the luminance value in each lighting time period is determined according to a duration of each lighting time period.

In other words, a drive controller 12*e* computes a luminance value of the backlight 12*a* in each lighting time period, based on the duration of each lighting time period of the backlight 12*a* and on the sum luminance value that is determined beforehand as a sum value of luminance of the backlight 12*a* from a time point when the backlight 12*a* is turned on to a time point when the backlight 12*a* is turned off. Then, the drive part 12*b* controls luminance of the backlight 12*a* based on the luminance value computed.

Concretely, when the sum luminance value in the lighting time period Ta is a sum value S1, the drive controller 13*e* computes the luminance La in the lighting time period Ta by dividing the sum value S1 of the luminance by the lighting time period Ta. In such a manner, the drive controller 13*e* computes each of the luminance values (La, Lb, and Lc) in each of the lighting time periods (Ta, Tb, and Tc) based on each duration of the lighting time periods and on each of the sum luminance values (S1, S2, and S3), and transmits to the drive part 12*b* a control signal for making the backlight 12*a* at each of the luminance values computed. Thus, variations among sum luminance values in the lighting time periods, caused by a change of the duration of the lighting time periods, can be controlled, and a clear image can be displayed for a user.

Third Embodiment

The following is a difference between a third embodiment and the first embodiment. In the first embodiment, the unlit time period of the backlight 12*a* is changed for each image in a frame. On the other hand, in the third embodiment, a duration of an unlit time period of the backlight 12*a* is not changed but fixed, and the unlit time period is moved on a time axis, in other words, a lighting time period is moved on the time axis. Thus a clear image is displayed for the user. The configuration and the process in the third embodiment is substantially the same as the configuration and the process in the first embodiment, except the move of a lighting time period on the time axis. Therefore, a description of a same portion in the configuration and in the process is omitted.

Figure 9A:
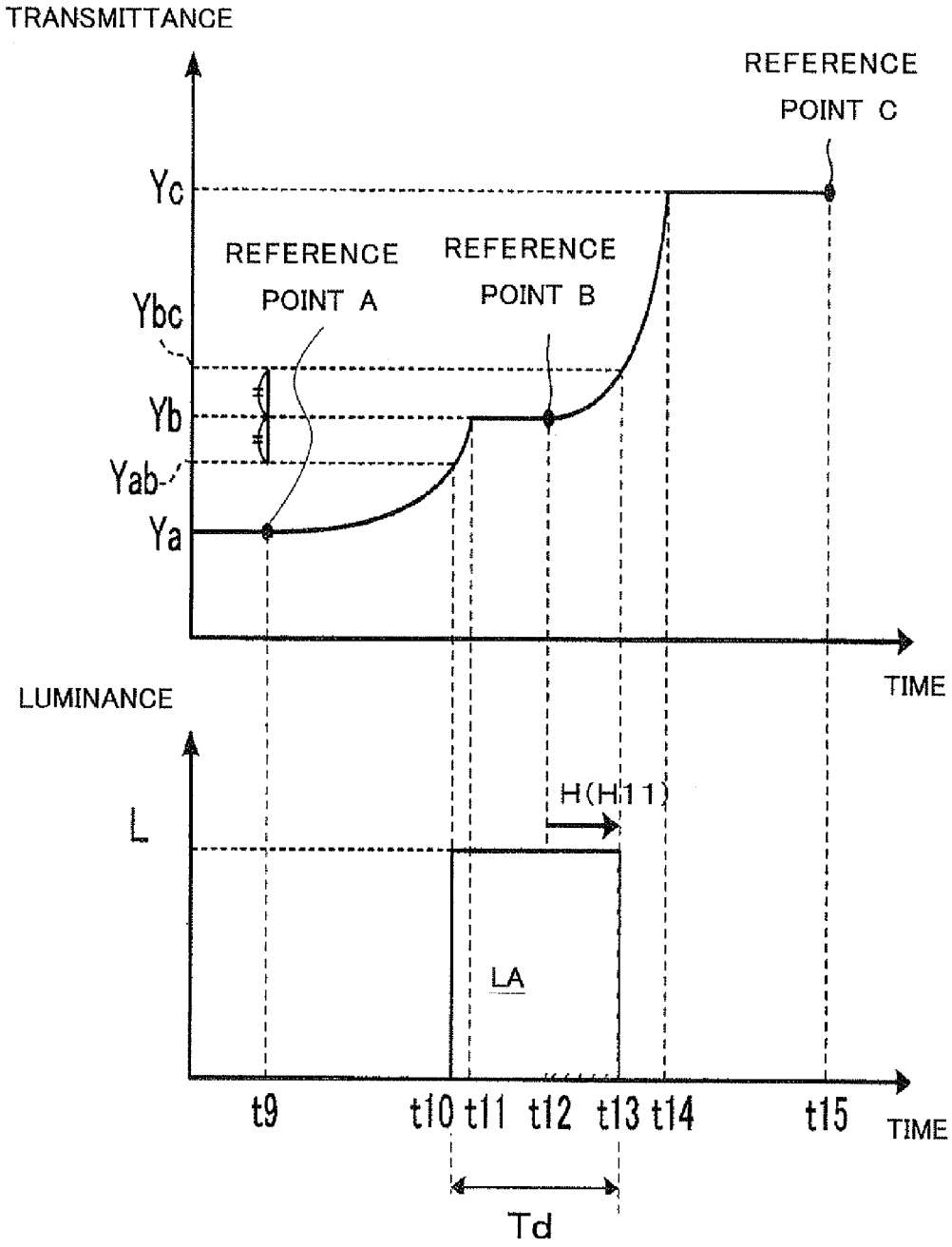
FIG. 9A illustrates an example of a process in a case where a lighting time period of a backlight is fixed.

FIG. 9A illustrates an example of a process performed in a case where a duration of a lighting time period Td of a backlight 12*a* is fixed. Moreover, FIG. 9B illustrates a timing table 114*c*.

Having the lighting time period Td and a luminance value L of the backlight 12*a* shown in FIG. 9A fixed, a time point when the backlight 12*a* is turned on and a time point when the backlight 12*a* is turned off are changed from a reference point (each of reference points A, B, and C shown in FIG. 9A). In other words, a setting part 13*d* sets an amount of move (move amount) H by which the time point when the backlight 12*a* is turned on and the time point when the backlight 12*a* is turned off are moved on the time axis. Then, without changing a duration of the lighting time period Td of the backlight 12*a*, the time point when the backlight 12*a* is turned on in the lighting time period Td and the time point when the backlight 12*a* is turned off in the lighting time period Td are changed based on the move amount H. The setting part 13*d* sets the move amount H for each of the lighting time periods. Thus, the backlight 12*a* is on for a shorter time in a period where a change of transmittance is great, and the backlight 12*a* is on for a longer time in a period where a change of transmittance is small. Therefore, an image having constant luminance can be provided to the user.

Concretely, the setting part 13*d* sets transmittances at the reference points A to C as a transmittance Ya (at the reference point A), a transmittance Yb (at the reference point B), and a transmittance Yc (at the reference point C) respectively, and sets a transmittance at a time point (a time point t10) when the backlight 12*a* is turned on in the lighting time period Td including the reference point B, as a transmittance Yab. The setting part 13*d* also sets a transmittance at a time point (a time point t13) when the backlight 12*a* is turned off in the lighting time period Td, as a transmittance Ybc. Then the setting part 13*d* moves the time point when the backlight 12*a* is turned on and the time point when the backlight 12*a* is turned off in the lighting time period Td, on the time axis, to make $|Yab-Yb|$ equal to $|Ybc-Yb|$.

In other words, the time point when the backlight 12*a* is turned on and the time point when the backlight 12*a* is turned off are moved to make a difference between the transmittance Yab at the time point (the time point 110) when the backlight 12*a* is turned on and the transmittance Yb at a target point (the reference point B) equal to a difference between the transmittance Ybc at the time point (the time point t13) when the backlight 12*a* is turned off and the transmittance Yb. In other words, the setting part 13*d* moves the time point when the backlight 12*a* is turned on and the time point when the backlight 12*a* is turned off in the lighting time period Td by the move amount H on the time axis. Thus, transmission fluctuation is minimized in the lighting time period, and a clear image can be displayed for the user. The time point (the time point t10) when the backlight 12*a* is turned on and the time point when (the time point t13) the backlight 12*a* is turned off are different as compared to each of the time points after the move. However, the duration of the lighting time period (the lighting time period Td) and the luminance value (the luminance L) do not change before and after the move. In other words, there is no change in a sum luminance value (LA) that is a sum value of luminance, before and after the move.

FIG. 9B illustrates a timing table 114*c* showing an offset time H11 corresponding to the move amount H for each combination of a first representative pattern and a second representative pattern.

In FIG. 9B, the first representative pattern is obtained from image data of an image in a frame before a change of the transmittance and from image data of an image in a frame after the change of the transmittance. The second representative pattern is obtained from image data of an image in a frame after the change of the transmittance and from image data of an image in a subsequent frame to be displayed on a LCD panel 11. Hereinafter, deriving methods for the first representative pattern and for the second representative pattern are described.

A specifying part 13*b* specifies a specific pattern for each of plural pixels in a time period in which a pre-change transmittance becomes a post-change transmittance. The specifying part 13*b* also specifies a specific pattern for each of the plural pixels of the LCD panel 11 in a time period in which the post-change transmittance becomes a transmittance subsequent to the post-change transmittance. In other words, the specifying part 13*b* specifies a response time for each of the plural pixels of the LCD panel 11 in the time period in which the pre-change transmittance becomes the post-change transmittance. Then, the specifying part 13*b* specifies a fluctuation tendency that shows a tendency of an increase or a decrease of the transmittance over time, for each of the plural pixels of the LCD panel 11. Moreover, the specifying part 13*b* specifies a specific response time for each of the plural pixels of the LCD panel 11 in the time period in which the post-change transmittance becomes a transmittance subsequent to the post-change transmittance. Then, the specifying part 13*b* specifies a specific fluctuation tendency showing a tendency of an increase or a decrease of the transmittance over time, for each of the plural pixels of the LCD panel 11.

A deriving part 13*c* derives the first representative pattern based on a predetermined condition, from the specific pattern for each of the plural pixels of the LCD panel 11 in a time period in which the pre-change transmittance becomes the post-change transmittance. Moreover, the deriving part 13*c* derives the second representative pattern based on a predetermined condition, from the specific response time and the specific fluctuation tendency in a time period in which the post-change transmittance becomes a transmittance subsequent to the post-change transmittance.

The setting part 13*d* selects the offset time H11 corresponding to the combination of the first and the second representative patterns, from the timing table 114*c* shown in FIG. 9B. Then the setting part 13*d* changes the time point when the backlight 12*a* is turned on and the time point when the backlight 12*a* is turned off in the lighting time period Td, without changing a predetermined duration of the lighting time period Td of the backlight 12*a*, according to the offset time H11 selected. Thus, the lighting time period of the backlight 12*a* can be shortened in the time period in which change in the transmittance is great, and the lighting time period of the backlight 12*a* can be longer in the time period in which change in the transmittance is small. As a result, an image having stable luminance can be provided to the user.

Concretely, the setting part 13*d* sets a time point t13 when the offset time H11 passes from the reference point B (at a time point t12) as a time point when lighting of the backlight 12*a* ends, in other words, when the backlight 12*a* is turned off. Moreover, the setting part 13*d* sets a time point t10 when the offset time H11 is turned back from the reference point B (at the time point t12) as a time point when the backlight 12*a* is turned on. In other words, the lighting time period Td includes the time point t10 when the lighting time period starts, the time point t13 when the lighting time period ends and the reference point Bin a center between them, and the lighting time period Td includes the offset time H11 from the time point t10 to the reference point B and also the offset time H11 from the reference point B to the time point t13.

In such a manner, the specifying part 13*b* further specifies the response time in which the post-change transmittance becomes a transmittance subsequent to the post-change transmittance, for each of the plural pixels. Then the deriving part 13*c* derives the first representative pattern based on the representative response time in which a pre-change transmittance becomes a post-change transmittance, for each of the plural pixels, and the representative fluctuation tendency. Moreover, the deriving part 13*c* derives the second representative pattern based on the representative specific response time in which the post-change transmittance becomes a transmittance subsequent to the post-change transmittance, for each of the plural pixels, and the representative specific fluctuation tendency.

Then the setting part 13*d* sets the offset time H11 in the lighting time period Td based on the combination of the first and the second representative patterns, and then changes the time points when the lighting time period of the backlight 12*a* starts and ends, based on the offset time H11. In other words, the setting part 13*d* changes the time points when the lighting time period Td of the backlight 12*a* starts and ends, based on the representative response time, the representative fluctuation tendency, the representative specific response time, and the representative specific fluctuation tendency, without changing the predetermined duration of the lighting time period Td of the backlight 12*a*. Thus, the lighting time period of the backlight 12*a* can be shortened in the time period in which change in the transmittance is great, and the lighting time period of the backlight 12*a* can be longer in the time period in which change in the transmittance is small. As a result, an image having stable luminance can be provided to the user.

<Modifications>

The embodiments of the invention are described above. The invention is not limited to the above embodiments but various modifications are possible. Such modifications are hereinafter described. All embodiments including the embodiments described above and the modifications described below can be optionally combined with another embodiment.

In the embodiment described above, the liquid crystal display apparatus 10 includes a backlight control apparatus (includes at least the specifying part 13*b*, the deriving part 13*c*, the setting part 13*d*, the drive controller 13*e* and the storage part 14 out of the structural elements shown in FIG. 2). However, the liquid crystal display apparatus 10 is not limited to the apparatus described in the embodiment above, but the backlight control apparatus may be provided separately from the liquid crystal display apparatus 10.

In the embodiment described above, the controller 13 included in the liquid crystal display apparatus 10 may specify the representative response time of a change of images on the LCD panel 11 based on representative transmittance data on the basis of the pre-change transmittance specified by image data of an image in a frame to be displayed on the LCD panel 11, and based on representative transmittance data on the basis of the post-change transmittance specified by image data of an image in a subsequent frame to be displayed on the LCD panel 11. Then the liquid crystal display apparatus 10 may set the lighting time period of the backlight 12*a* according to the representative response time specified. Thus, a clear image can be displayed for the user.

In the embodiments mentioned above, an entire display area of the LCD panel 11 is described as one region. However, the specifying part 13*b* may divide the display area of the LCD panel 11 into a plurality of regions, and may select a representative pixel based on a predetermined condition, from amongst pixels in each of the plurality of regions divided, and may specify a specific pattern based on a change of the transmittance of the representative pixel selected. Then the deriving part 13*c* derives a representative pattern, using the specific pattern of the representative pixel for each of the plurality of regions divided.

For example, the deriving part 13*c* derives an average of the specific patterns of the representative pixels of the plurality of regions divided, as the representative pattern. Then the setting part 13*d* sets an unlit time period of the backlight 12*a*, by using the representative pattern.

In the embodiments mentioned above, the specifying part 13*b* may divide the display area of the LCD panel 11 into a plurality of regions, and may specify a change of an average transmittance of a pixel in each of the plurality of regions divided, based on a predetermined condition. Then the deriving part 13*c* derives the representative pattern by using the change of the average transmittance specified for each of the plurality of regions divided.

For example, in a case where the transmittances of pixels included in one of the plurality of regions divided in an image in a frame are 40% (at a pixel A), 60% (at a pixel B), and 20% (at a pixel C) respectively, an average transmittance of the one region is 40%. And, for example, in a case where the transmittances of pixels included in one of the plurality of regions divided, in an image in a subsequent frame, are 60% (at the pixel A), 80% (at the pixel B), and 70% (at the pixel C) respectively, an average transmittance of the one region is 70%. The deriving part 13*c* derives a representative pattern based on a predetermined condition, by using information of the change (from 40% to 70%) of the average transmittance or the like. Then the setting part 13*d* sets the unlit time period of the backlight by using the representative pattern derived based on the change of the average transmittance for each of the plurality of regions divided.

Moreover, in the explanation of setting the offset time in the embodiments described above, the time point when the backlight is turned of is moved to a later time point to shorten the unlit time period and the time point when the backlight is turned on is moved to an earlier time point to shorten the unlit time period. On the other hand, only one of the time points may be moved. In other words, one of the offset time H1 and the offset time H2 may be set in the unlit time period. Moreover, only the offset time H2 may be set at a time point when a change rate of the transmittance is smaller (e.g. the time point t4 in FIG. 6A), and an offset time may not be set at a time point when a change rate of the transmittance is greater.

While the invention has been shown and described in detail, the foregoing description is in all aspects illustrative and not restrictive. It is therefore understood that numerous other modifications and variations can be devised without departing from the scope of the invention.

What is claimed is:

1. A control apparatus that controls a backlight providing light to a liquid crystal display panel, the control apparatus comprising:

a controller configured to:

(i) specify a response time required for a pre-change transmittance specified by image data of an image to be displayed on the liquid crystal display panel to become a post-change transmittance specified by image data of a subsequent image, subsequent to the image, to be displayed on the liquid crystal display panel, for each pixel of the liquid crystal display panel, based on the pre-change transmittance and on the post-change transmittance;

(ii) derive a representative response time defined as a response time of an image in a frame, based on the response time specified for each of the pixels; and (iii) set an unlit time period of the backlight, between display of the image and the subsequent image, according to the representative response time so that the unlit time period of the backlight varies depending on a value of the representative response time.

2. A control apparatus that controls a backlight providing light to a liquid crystal display panel, the control apparatus comprising:

a controller configured to:

(i) specify a response time required for a pre-change transmittance specified by image data of an image to be displayed on the liquid crystal display panel to become a post-change transmittance specified by image data of a subsequent image, subsequent to the image, to be displayed on the liquid crystal display panel, for each pixel of the liquid crystal display panel, based on the pre-change transmittance and on the post-change transmittance;

(ii) derive a representative response time defined as a response time of an image in a frame, based on the response time specified for each of the pixels; and (iii) set an unlit time period of the backlight, between display of the image and the subsequent image, according to the representative response time, wherein the controller is further configured to:

as part of (i), specify a fluctuation tendency showing one of an increase and a decrease of the transmittance over time, for each of the pixels;

as part of (ii), derive a representative fluctuation tendency defined as a fluctuation tendency of an image in a frame, based on the fluctuation tendency specified for each of the pixels; and as part of (iii), set an offset time in the unlit time period based on the representative response time and the representative fluctuation tendency.

3. The control apparatus according to claim 2, wherein the controller is configured to:

as part of (ii), derive the representative response time and the representative fluctuation tendency based on a distribution of pixels of the liquid crystal display panel with respect to the response time and the fluctuation tendency.

4. The control apparatus according to claim 2, wherein the controller is configured to:

as part of (iii), set a first offset time that is the offset time set to a time point when the unlit time period starts so as to be shorter than a second offset time that is the offset time set to a time point when the unlit time period ends, when the representative fluctuation tendency shows a decrease, and set the first offset time to be longer than the second offset time when the representative fluctuation tendency shows an increase.

5. A control apparatus that controls a backlight providing light to a liquid crystal display panel, the control apparatus comprising:

a controller configured to:

(i) specify a response time required for a pre-change transmittance specified by image data of an image to be displayed on the liquid crystal display panel to become a post-change transmittance specified by image data of a subsequent image, subsequent to the image, to be displayed on the liquid crystal display panel, for each pixel of the liquid crystal; display panel, based on the pre-change transmittance and on the post-change transmittance;

(ii) derive a representative response time defined as a response time of an image in a frame, based on the response time specified for each of the pixels; and (iii) set an unlit time period of the backlight, between display of the image and the subsequent image, according to the representative response time, wherein the controller is further configured to:

compute a value of luminance of the backlight in a lighting time period based on a duration of each lighting time period of the backlight and on a sum luminance value determined in advance as a sum value of luminance of the backlight in a time period from a time point when the lighting time period of the backlight starts to a time point when the lighting time period of the backlight ends.

6. A control apparatus that controls a backlight providing light to a liquid crystal display panel, the control apparatus comprising:

a controller configured to:

(i) specify a response time required for a pre-change transmittance specified by image data of an image to be displayed on the liquid crystal display panel to become a post-change transmittance specified by image data of a subsequent image, subsequent to the image, to be displayed on the liquid crystal display panel, for each pixel of the liquid crystal display panel, based on the pre-change transmittance and on the post-change transmittance;

(ii) derive a representative response time defined as a response time of an image in a frame, based on the response time specified for each of the pixels; and (iii) set an unlit time period of the backlight, between display of the image and the subsequent image, according to the representative response time, wherein the controller is further configured to:

divide the liquid crystal display panel into a plurality of regions, and wherein, as part of (iii), the controller is configured to set the lighting time period of the backlight based on a change of an average transmittance of the pixels in each of the plurality of regions.

7. The control apparatus according to claim 1, wherein the controller is further configured to:

divide the liquid crystal display panel into a plurality of regions, and wherein, as part of (iii), the controller is configured to set the lighting time period of the backlight based on a change of a transmittance of a representative pixel in each of the plurality of regions.

8. A control apparatus that controls a backlight providing light to a liquid crystal display panel, the control apparatus comprising:

a controller configured to:

(i)(a) specify a response time required for a pre-change transmittance specified by image data of an image to be displayed on the liquid crystal display panel to become a post-change transmittance specified by image data of a subsequent image, subsequent to the image, to be displayed on the liquid crystal display panel, for each pixel of the liquid crystal display panel, based on the pre-change transmittance and on the post-change transmittance, (b) specify a fluctuation tendency showing one of an increase and a decrease of the transmittance over time for each of the pixels; and (c) specify a specific response time required for the post-change transmittance to become a next transmittance and a specific fluctuation tendency, for each of the pixels;

(ii) (a) derive a representative response time defined as a response time of an image in a frame, based on the response time specified for each of the pixels, (b) derive a representative fluctuation tendency defined as a fluctuation tendency of an image of a frame, based on the fluctuation tendency specified for each of the pixels, (c) derive a representative specific response time defined as a specific response time of the subsequent image in a frame, subsequent to the image in the frame, to be displayed on the liquid crystal display panel, based on the specific response time, and (d) derive a representative specific fluctuation tendency defined as a specific fluctuation tendency of the subsequent image in a frame, subsequent to the image in the frame displayed, to be displayed on the liquid crystal display panel; and (iii) change a time point when the lighting time period starts and a time point when the lighting time period ends, based on the representative response time, the representative fluctuation tendency, the representative specific response time, and the representative specific fluctuation tendency, without changing a predetermined duration of the lighting time period of the backlight.

9. A control method, executed by a display panel controller, that controls a backlight providing light to a liquid crystal display panel, the control method comprising the steps of:

(a) specifying a response time required for a pre-change transmittance specified by image data of an image to be displayed on the liquid crystal display panel to become a post-change transmittance specified by image data of a subsequent image, subsequent to the image, to be displayed on the liquid crystal display panel, for each pixel of the liquid crystal display panel, based on the pre-change transmittance and on the post-change transmittance;

(b) deriving a representative response time defined as a response time of an image in a frame, based on the response time specified for each of the pixels; and (c) setting an unlit time period of the backlight, between display of the image and the subsequent image, according to the representative response time so that the unlit time period of the backlight varies depending on a value of the representative response time.

10. A control method, executed by a display panel controller, that controls a backlight providing light to a liquid crystal display panel, the control method comprising the steps of:

(a) specifying a response time required for a pre-change transmittance specified by image data of an image to be displayed on the liquid crystal display panel to become a post-change transmittance specified by image data of a subsequent image, subsequent to the image, to be displayed on the liquid crystal display panel, for each pixel of the liquid crystal display panel, based on the pre-change transmittance and on the post-change transmittance;

(b) deriving a representative response time defined as a response time of an image in a frame, based on the response time specified for each of the pixels; and (c) setting an unlit time period of the backlight, between display of the image and the subsequent image, according to the representative response time, wherein the step (a) specifies a fluctuation tendency showing one of an increase and a decrease of the transmittance over time, for each of the pixels;

the step (b) derives a representative fluctuation tendency defined as a fluctuation tendency of an image in a frame, based on the fluctuation tendency specified for each of the pixels; and the step (c) sets an offset time in the unlit time period based on the representative response time and the representative fluctuation tendency.

11. The control method according to claim 10, wherein the step (b) derives the representative response time and the representative fluctuation tendency based on a distribution of pixels of the liquid crystal display panel with respect to the response time and the fluctuation tendency.

12. The control method according to claim 10, wherein the step (c) sets a first offset time that is the offset time set to a time point when the unlit time period starts so as to be shorter than a second offset time that is the offset time set to a time point when the unlit time period ends, when the representative fluctuation tendency shows a decrease, and sets the first offset time to be longer than the second offset time when the representative fluctuation tendency shows an increase.

13. A control method, executed by a display panel controller, that controls a backlight providing light to a liquid crystal display panel, the control method comprising the steps of:

(a) specifying a response time required for a pre-change transmittance specified by image data of an image to be displayed on the liquid crystal display panel to become a post-change transmittance specified by image data of a subsequent image, subsequent to the image, to be displayed on the liquid crystal display panel, for each pixel of the liquid crystal display panel, based on the pre-change transmittance and on the post-change transmittance;

(b) deriving a representative response time defined as a response time of an image in a frame, based on the response time specified for each of the pixels;

(c) setting an unlit time period of the backlight, between display of the image and the subsequent image, according to the representative response time; and (d) computing a value of luminance of the backlight in a lighting time period based on a duration of each lighting time period of the backlight and on a sum luminance value determined in advance as a sum value of luminance of the backlight in a time period from a time point when the lighting time period of the backlight starts to a time point when the lighting time period of the backlight ends.

14. A control method, executed by a display panel controller, that controls a backlight providing light to a liquid crystal display panel, the control method comprising the steps of:

(a) specifying a response time required for a pre-change transmittance specified by image data of an image to be displayed on the liquid crystal display panel to become a post-change transmittance specified by image data of a subsequent image, subsequent to the image, to be displayed on the liquid crystal display panel, for each pixel of the liquid crystal display panel, based on the pre-change transmittance and on the post-change transmittance;

(b) deriving a representative response time defined as a response time of an image in a frame, based on the response time specified for each of the pixels:

(c) setting an unlit time period of the backlight, between display of the image and the subsequent image, according to the representative response time; and (d) dividing the liquid crystal display panel into a plurality of regions, wherein the step (c) sets the lighting time period of the backlight based on a change of an average transmittance of the pixels in each of the plurality of regions.

15. The control method according to claim 9, further comprising the step of (f) dividing the liquid crystal display panel into a plurality of regions, wherein the step (c) sets the lighting time period of the backlight based on a change of a transmittance of a representative pixel in each of the plurality of regions.

* * * * *